US005080090A

United States Patent [19]

Liau et al.

[11] Patent Number: 5,080,090

[45] Date of Patent: Jan. 14, 1992

[54] MASSAGE MAT OF SELF-SERVICE TYPE FOR USE IN STIMULATING THE CIRCULATORY SYSTEM OF A HUMAN BODY

[76] Inventors: Yo-Chong Liau; Gin-Hui Yan, both of No. 10, Alley 61, Lane 45, Ching Mei Road, Taiping Hsiang, Taichung, Taiwan

[21] Appl. No.: 577,003

[22] Filed: Sep. 4, 1990

[51] Int. Cl.[5] ..... A61H 7/00

[52] U.S. Cl. ..... 128/60; 128/25 B; 128/62 R

[58] Field of Search ..... 128/59, 60, 61, 25 B, 128/62-64, 56-58

[56] References Cited

U.S. PATENT DOCUMENTS 1,981,379 4/1933 Thomson et al. ..... 128/25 B
2,836,175 5/1958 Nakayama ..... 128/60
3,625,204 12/1971 Sekiguchi ..... 128/60
3,885,555 5/1975 Nobbs ..... 128/25 B

FOREIGN PATENT DOCUMENTS 530036 7/1931 Fed. Rep. of Germany ..... 128/60

*Primary Examiner*—Robert A. Hafer
*Assistant Examiner*—David J. Kenealy

[57] ABSTRACT

A massage mat of self-service type for use in stimulating the circulatory system of a human body comprises a plurality of elastomers with hollow interiors. An arc-shaped nipple is disposed on the top of each elastomer. Each elastomer is connected by four bridges. The elastomers includes a plurality of primary elastomers and a plurality of secondary elastomers. The bottom of each primary elastomer is connected by two of the bridges transversely and two of the bridges longitudinally. The middle portion of each secondary elastomer is connected by two of the bridges transversely and two of the bridges longitudinally.

3 Claims, 5 Drawing Sheets

A – A

MASSAGE MAT OF SELF-SERVICE TYPE FOR USE IN STIMULATING THE CIRCULATORY SYSTEM OF A HUMAN BODY

BACKGROUND OF THE PRESENT INVENTION

The present invention relates to the device used in the ancient chinese medical therapy similar to acupuncture in theory, and particularly to a massage mat of self-service type for use in stimulating the circulatory system of a human body.

The present invention is based on the theory that the metabolic activities of a human body are under the control of the "energy", which circulates along the circulatory system throughout a human body. Several researches with respect to the relative effectiveness of the therapeutical treatment based on the theory mentioned above have been reported in the United States, Germany, and Japan.

An obstructive force, either exogenous or endogenous, responsible for the development of a physiological abnormality of a human body may induce the circulatory system to respond immediately by means of a blockade of the "energy" at a specific point of the circulatory system. The art of the ancient Chinese medical therapy involves the identification as well as the removal of the blockaded energy that is obstructing the normal metabolic activities of a human body.

One of the methods used in removing the blockaded energy that has taken place at a specific point of the circulatory system is the so-called finger-tip massage as shown in FIG. 1, in which a thumb is used to apply a gentle pressure on the spot where the blockaded energy has occurred. The motion sequences involved in the finger-tip massage are shown in FIGS. 1A, 1B and 1C. As shown in FIG. 1A, a gentle pressure is placed on the spot with a thumb, which is then used to apply a greater pressure on the spot, as shown in FIG. 1B. FIG. 1C shows that the thumb is subsequently withdrawn from the sport. A skillful and repetitive finger-tip massage elaborated in FIGS. 1A, 1B, and 1C is believed to be capable of removing the blockaded energy form the circulatory system of a human body.

There is a variety of the sole massage devices designed for use in stimulating the circulatory system of a human body. Unfortunately, these devices are often so poorly designed as to cause uncomfortable sensation or even injury to sole when a subject steps on the devices. This shortcoming prevents these devices from being well accepted by the consumers at large.

Therefore, the primary objective of the present invention is to provide a massage mat of the type designed to be used conveniently, comfortably, and effectively at any time and any place for the purpose of stimulating the circulatory system of a human body.

SUMMARY OF THE PRESENT INVENTION

The present invention relates to a massage mat of self-service type for use in stimulating the circulatory system of a human body. The embodiment of the present invention comprises a plurality of main bodies containing a plurality of elastomers of different heights being alternately arranged throughout their interior portion. The elastomers have an acr-shaped nipple located at their top portion. Located between elastomers are resilient and deformable bridges which serve to help maintain the heights of elastomers under pressure in order to attain the objective of stimulating the circulatory system of a human body.

DESCRIPTION OF THE PREFERRED EMBODIMENT

Figure 2:
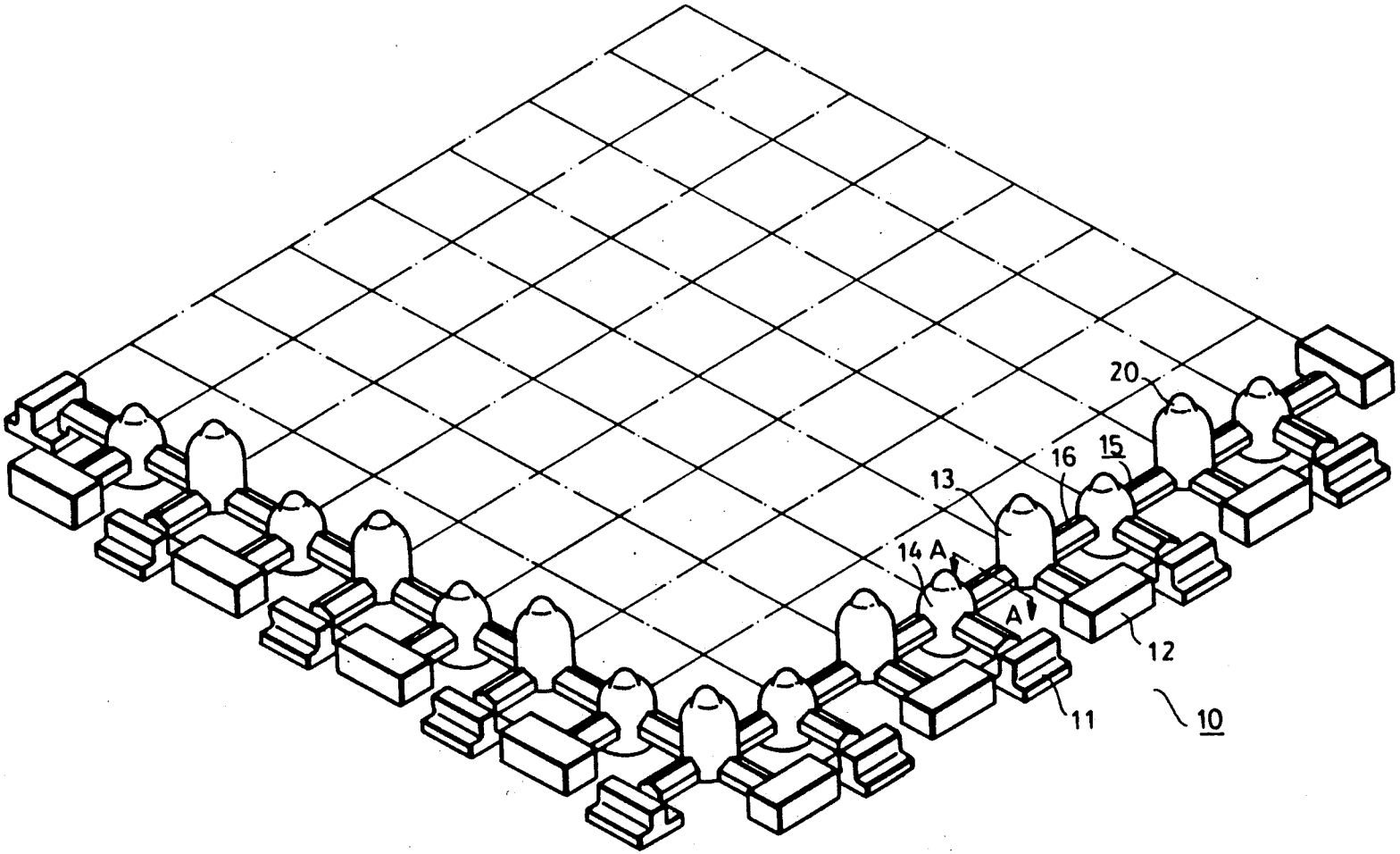
FIG. 2 shows a three-dimensional view of the embodiment according to the present invention.
Figure 3:
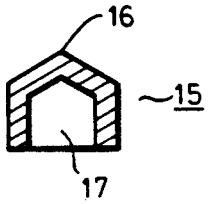
FIG. 3 shows a cross-sectional view of the A—A portion in FIG. 2.
Figure 4:
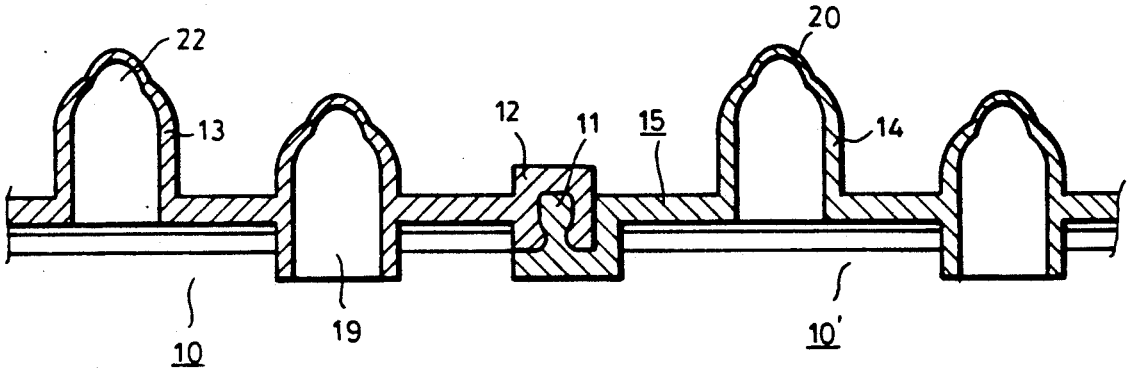
FIG. 4 shows a cross-sectional view of the embodiment of the present invention, showing the component parts.
Figure 9:
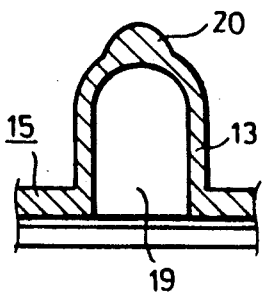
FIG. 9 shows an another cross-sectional view of an elastomer used as a component material of the embodiment of the present invention.
Figure 8:
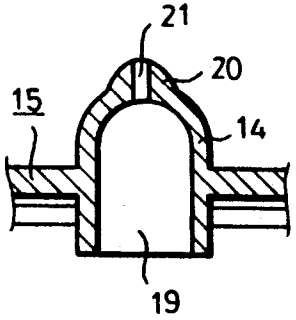
FIG. 8 shows a cross-sectional view of an elastomer used as a component material of the embodiment of the present invention.
Figure 7:
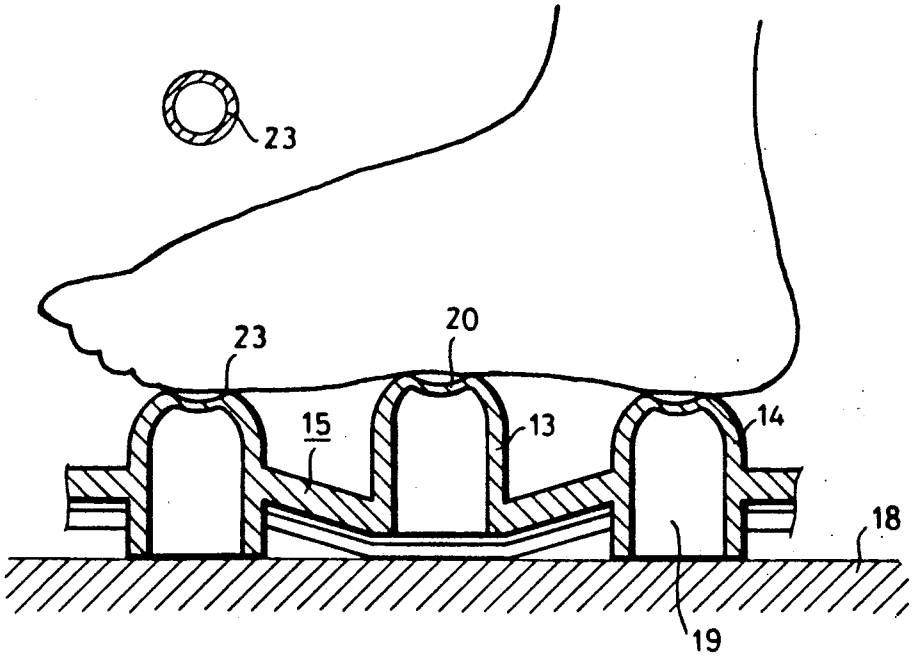
FIG. 7 shows an illustration of a heavy pressure exerted on the embodiment of the present invention by a sole.

Referring to FIG. 2, the embodiment of the present invention is made of an injection-molded rubber material and comprises a plurality of the square main bodies 10 whose margins are disposed with male fasteners 11 and female fasteners 12 which are so alternately arranged that they serve to hold together other units of similarly constructed main bodies 10, as shown in FIG. 4. The entire interior portion of the main body 10 is disposed transversely and longitudinally with a plurality of alternately-arranged elastomers 13 and 14 of different heights, with the former being higher than the latter. The primary elastomer 13 is connected to the secondary elastomer 14 by means of an elastic and deformable bridge 15 whose top center is slightly protruded to form an edge portion 16 and whose in a cross-sectional view of the A—A portion in FIG. 3. Now referring to FIG. 5, one primary elastomer 13 is situated between at least two secondary elastomers 14 whose bottom are lower than that of the primary elastomer 13. Primary elastomer 13 is connected by four bridges 15. The middle portion of each secondary elastomer 14 is connected by four bridges 15 also. When an initial pressure p is exerted axially on the elastomer 13, the base interval between the two elastomers 14 constitutes a horizontal support surface 18, which works together with the elastic and deformable bridge 15 to generate a resistance force F. In addition, the base portions of both elastomers 13 and 14 have an axial cavity 19 disposed therein to enhance their elastic and deformable capacities, as shown respectively in FIGS. 8 and 9. The nipple 20 located at the top of both elastomers 13 and 14 serves to provide an additional support. If a greater support is desired, an apex hole 21 of a small diameter can be disposed at the center of the nipple 20, resulting in a reduction in its surface area, as shown in FIG. 9. Now referring to FIG. 5, the base of the nipple 20 has a recess 22 disposed therein, which communicates with the axial cavity 19. As a result, the nipple 20, when under pressure, can be forced into the axial cavity 19, as shown in FIG. 7. On the other hand, when the pressure is removed, the axial nipple 20 is capable of withdrawing itself from the cavity 19, thanks to its own intrinsic elasticity.

Figure 1:
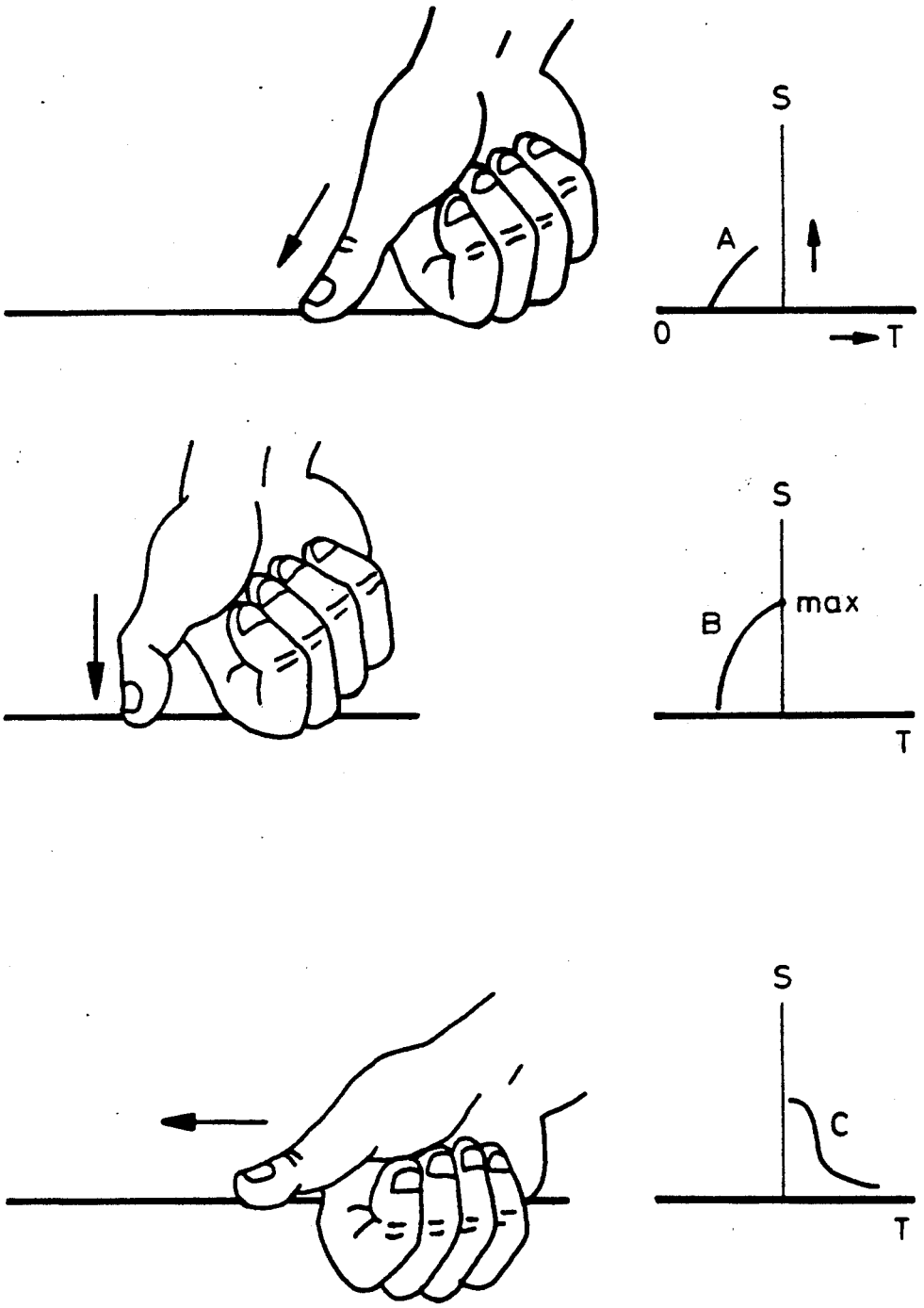
FIG. 1 shows an illustration of the art of the finger-tip massage practiced by a professional massage practitioner.
Figure 5:
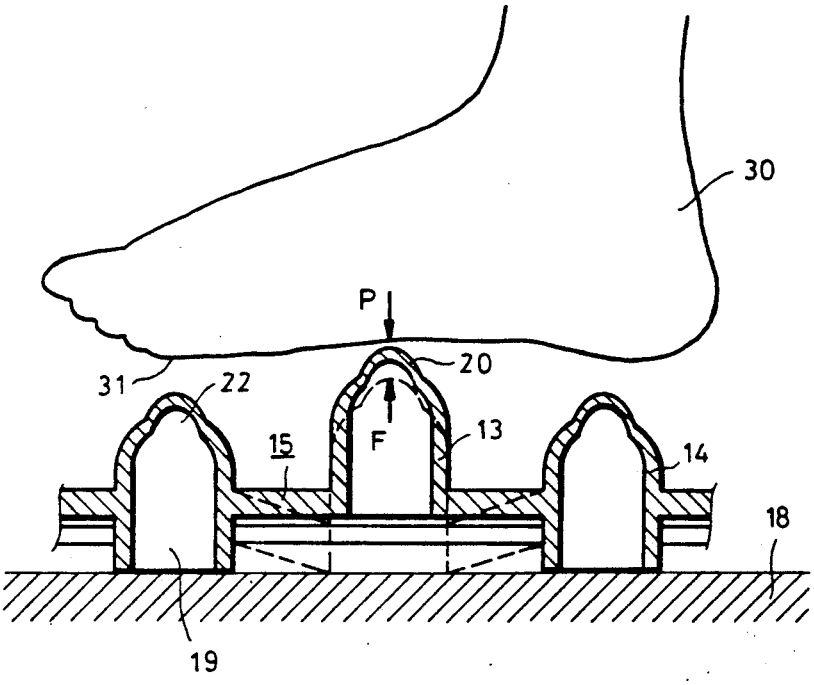
FIG. 5 shows an illustration of the initial contact between a sole and the embodiment of the present invention.
Figure 6:
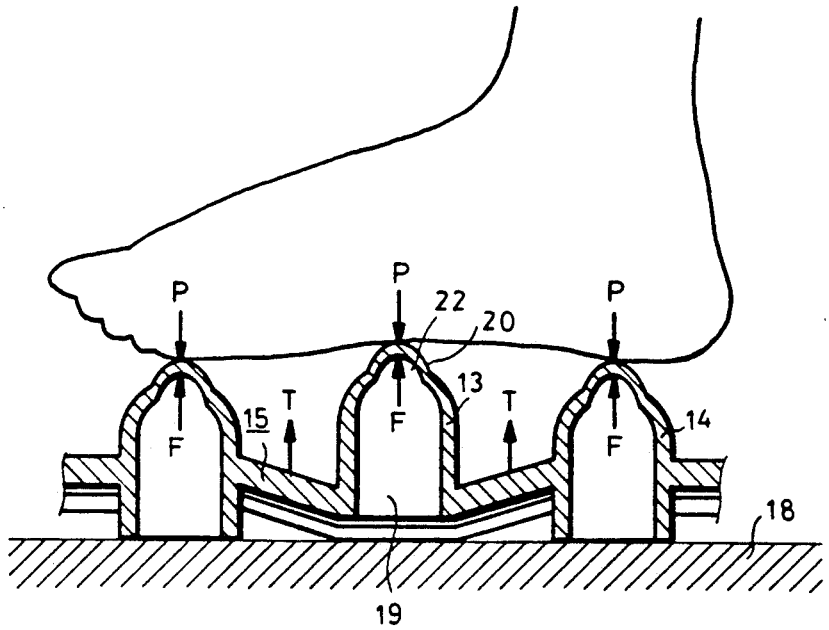
FIG. 6 shows an illustration of the complete contact between a sole and the embodiment of the present invention.

As mentioned before, the embodiment of the present invention comprises a plurality of main bodies 10, attached together by means of male fasteners 11 and female fasteners 12 thereof, to form a massage mat of a desired length. It is desirable to mention here the basic mechanism involved in engendering an intended result by a massage mat of the present invention. Referring to FIG. 5, it is always the sole 31 of a foot 30 that makes an immediate contact with the primary elastomer 13, which becomes compressed as soon as the sole 31 begins to exert a greater pressure on it, as shown in FIG. 6. As a result, the bridges 15 are, in turn, under pressure, resulting in the generation of an upward resistance force T. As the sole 31 continues to put pressure on the primary elastomer 13, which will eventually be compressed to the extent that the sole 31 will put a great pressure on the secondary elastomer 14 as well, as shown in FIG. 6. If the pressure exerted by the sole 31 on the elastomers 13 and 14 persists, the nipple 20 will become so compressed and deformed that it is forced into the axial cavity 19, as shown in FIG. 7. Therefore, the circular surface 23 located just between the nipple 20 and the axial cavity 19 is the area on which the force concentrates. At the very moment when the sole 31 is withdrawing from the elastomers 13 and 14, the forces deriving respectively from the expansion of the resilient bridge 15 and nipple 20 will exert a pressure on the sole 31 which is withdrawing from the surface of the massage mat of the present invention, resulting in the attainment of the same intended effect of the finger-tip massage as described before and shown in FIG. 1.

It is believed, on the basis of the theory of the ancient Chinese medical therapy, that the sole of a human body represents the most sensitive area which communicates most effectively with the circulatory system. For this reason, the stimulation of the human sole by means of an appropriate mechanical means, such as the massage mat of the present invention, can effectively relieve the abnormality of the metabolic activity.

I claim:

1. A massage mat of self-service type for use in stimulating the circulatory system of a human body comprising:

a plurality of elastomers with hollow interiors;

each of said elastomers connecting to four bridges;

said elastomers including a plurality of primary elastomers and a plurality of secondary elastomers;

a bottom of each of said primary elastomer connecting to two of said bridges transversely and two of said bridges longitudinally;

a middle portion of each of said secondary elastomer connecting to two of said bridges transversely and two of said bridges longitudinally;

an arc-shaped nipple disposed on a top of each of said elastomer.

2. a massage mat of self-service type for use in stimulating the circulatory system of a human body as claimed in claim 1, wherein said bridges are resilient and deformable.

3. a massage mat of self-service type for use in stimulating the circulatory system of a human body as claimed in claim 1, wherein an apex hole is formed on an upper center of each of said nipple.

* * * * *